US012610990B1

(12) United States Patent
Goodrich

(10) Patent No.: US 12,610,990 B1
(45) Date of Patent: Apr. 28, 2026

(54) LEG LOOP UNDERGARMENT

(71) Applicant: Ghost Panty LLC, Newport News, VA (US)

(72) Inventor: Kathryn E. Goodrich, Newport News, VA (US)

(73) Assignee: GHOST PANTY LLC, Newport News, VA (US)

( * ) Notice: Subject to any disclaimer, the term of this patent is extended or adjusted under 35 U.S.C. 154(b) by 0 days.

(21) Appl. No.: 18/975,203

(22) Filed: Dec. 10, 2024

(51) Int. Cl.
*A41B 9/00* (2006.01)

(52) U.S. Cl.
CPC ..... *A41B 9/002* (2013.01)

(58) Field of Classification Search
CPC .. A41B 9/002; A41B 9/00; A41B 9/04; A41B 9/001; A41B 9/12
See application file for complete search history.

(56) References Cited

U.S. PATENT DOCUMENTS 452,529 A * 5/1891 Pfister ..... A41B 9/02 2/238
563,408 A * 7/1896 Pfister ..... A41D 1/088 2/400
1,837,483 A * 12/1931 Cecil-Reaney ..... A61F 13/64 604/401
1,920,648 A * 8/1933 Lane ..... A61F 5/40 602/70
1,929,506 A * 10/1933 Mcdonald ..... A41B 9/08 2/78.3
1,989,686 A * 2/1935 Deutsch ..... A61F 13/64 604/401
RE21,624 E * 11/1940 Dann ..... A41B 9/04 2/406
2,977,957 A * 4/1961 Clyne ..... A61F 13/64 604/398
3,073,309 A * 1/1963 Mosier ..... A61F 13/64 604/402
3,117,577 A * 1/1964 Mosier ..... A61F 13/64 604/401
3,121,427 A * 2/1964 Mosier ..... A61F 13/64 604/364
3,225,765 A * 12/1965 Mosier ..... A61F 13/64 604/397
3,375,826 A * 4/1968 Field ..... A61F 13/64 604/402
3,455,303 A * 7/1969 Wilson ..... A61F 13/64 604/402
3,963,022 A * 6/1976 Rotello ..... A61F 5/40 2/403
4,229,835 A * 10/1980 Shaw ..... A41B 9/001 2/221

(Continued)

FOREIGN PATENT DOCUMENTS

GB 2249941 A * 5/1992 ..... A41B 9/008

*Primary Examiner* — Heather Mangine
(74) *Attorney, Agent, or Firm* — Peter J. Van Bergen

(57) ABSTRACT

An undergarment includes a fabric panel and a strip of elastic material. The fabric panel has a first end and a second end. The strip of elastic material has a central region, a first outboard end, and a second outboard end. The strip's width tapers from the central region to each of the first and second outboard ends. The central region is coupled to the first end of the fabric panel. The strip's first outboard end and second outboard end are respectively coupled to opposing sides of the second end of the fabric panel.

10 Claims, 8 Drawing Sheets

(56) References Cited

U.S. PATENT DOCUMENTS 4,506,390 A * 3/1985 Stern ..... A41D 1/21 2/221
4,905,323 A * 3/1990 Lampman ..... A41B 9/008 2/46
4,920,769 A * 5/1990 Rickerl ..... A41B 9/004 2/406
4,964,860 A * 10/1990 Gipson ..... A61F 5/4401 604/391
5,143,092 A * 9/1992 Flowers ..... A41C 1/02 450/133
5,275,592 A * 1/1994 Grizzaffi ..... A61F 5/4401 2/403
H1440 H * 5/1995 New ..... A61F 5/4401 604/386
5,528,775 A * 6/1996 Marenda ..... A41B 9/002 2/406
5,706,524 A * 1/1998 Herrin ..... A61F 13/64 2/400
5,902,170 A * 5/1999 Ganz ..... A41C 1/02 450/94
5,954,564 A * 9/1999 Ganz ..... A41C 1/003 450/106
6,058,514 A * 5/2000 Hart ..... A41B 9/001 2/408
6,139,515 A * 10/2000 Ito ..... A61F 5/40 602/70
6,270,469 B1 * 8/2001 Mott ..... A41D 13/1254 602/61
6,334,223 B1 * 1/2002 Pieri ..... A41D 1/088 2/403
6,546,564 B1 * 4/2003 Palmer ..... A41B 9/14 2/409
6,560,786 B2 * 5/2003 Lipton ..... A41B 9/008 2/400
7,241,252 B1 * 7/2007 Gagliardi ..... A63B 21/4025 2/400
D575,929 S * 9/2008 Dacumos ..... D2/712
D599,527 S * 9/2009 Rishty ..... D2/704
D609,879 S * 2/2010 Servance-Booth ..... D2/712
7,685,652 B2 3/2010 Digney
8,603,062 B1 * 12/2013 Smith ..... A61F 13/491 604/387
11,517,055 B1 * 12/2022 Cristiano ..... A41B 9/002
2005/0210565 A1 * 9/2005 Mecsics ..... A41B 9/04 2/400
2006/0236443 A1 * 10/2006 Digney ..... A41B 9/002 2/406
2007/0174950 A1 * 8/2007 Gidish ..... A41C 1/003 2/406
2008/0127399 A1 * 6/2008 Pages I Piella ..... A41B 9/002 2/400
2008/0276353 A1 * 11/2008 Franko ..... A41B 9/002 2/406
2010/0251463 A1 * 10/2010 Rishty ..... A41B 9/04 2/406
2011/0245794 A1 * 10/2011 Hermansson ..... A61F 13/5622 604/391
2013/0225046 A1 * 8/2013 Kitagawa ..... A41C 1/003 450/100
2013/0263362 A1 * 10/2013 Wexler ..... A41D 1/06 2/400
2014/0189936 A1 * 7/2014 Lin ..... A61F 5/451 2/403
2014/0259305 A1 * 9/2014 Martin ..... A41B 9/001 2/400
2015/0096112 A1 * 4/2015 Velez ..... A41B 9/002 2/400
2015/0173423 A1 * 6/2015 Pardo ..... A41B 9/14 112/475.09
2016/0353806 A1 * 12/2016 Mendonça Coutsoumbos ..... A41B 9/04
2019/0142074 A1 * 5/2019 Benjamin ..... A41B 9/004 2/407
2021/0251303 A1 * 8/2021 Collins ..... A41B 17/00
2021/0289867 A1 * 9/2021 Koen ..... A41B 1/06
2023/0051292 A1 * 2/2023 Umebayashi ..... A61F 13/64
2024/0122271 A1 * 4/2024 Perry ..... A41B 17/005
2024/0341370 A1 * 10/2024 Morales ..... A41B 9/023
2025/0212972 A1 * 7/2025 Raut ..... A61F 13/496
2025/0212973 A1 * 7/2025 Sofer ..... A41B 9/02

* cited by examiner

LEG LOOP UNDERGARMENT

FIELD OF THE DISCLOSURE

This disclosure relates generally to undergarments, and more particularly to an undergarment held in place by two leg loops to minimize its visibility when worn under an outer garment.

BACKGROUND

When wearing form-fitting, lower-body outer garments (e.g., tights, yoga pants, dress pants, shorts, skirts, dresses, etc.), it is often preferred to wear an undergarment that is not visible (i.e., no "panty lines") to give the appearance of one wearing no undergarment. However, traditional undergarments to include brief, bikini, and thong-style undergarments fall short of the invisibility goal owning to their configurations to include the need for a waistband. In addition, traditional undergarments suffer from "bunching" that tends to be highly visible and uncomfortable. While not wearing any undergarment truly achieves the invisible appearance goal, such omission presents hygiene issues as well as the potential for staining of the outer garment.

SUMMARY

Accordingly, it is an object of the present disclosure to describe undergarments that are comfortable and minimally visible when worn under lower-body outer garments.

Other objects and advantages of the methods and systems described herein will become more obvious hereinafter in the specification and drawings.

In accordance with methods and systems described herein, an undergarment includes a fabric panel and a strip of elastic material. The fabric panel has a first end and a second end. The strip of elastic material has a central region, a first outboard end, and a second outboard end. The strip's width tapers from the central region to each of the first outboard end and the second outboard end. The central region is coupled to the first end of the fabric panel. The first outboard end and second outboard end of the strip are respectively coupled to opposing sides of the second end of the fabric panel.

BRIEF DESCRIPTION OF THE DRAWINGS

Other objects, features and advantages of the methods and systems described in the present disclosure will become apparent upon reference to the following description of the preferred embodiments and to the drawings, wherein corresponding reference characters indicate corresponding parts throughout the several views of the drawings and wherein.

DETAILED DESCRIPTION

Figure 1:
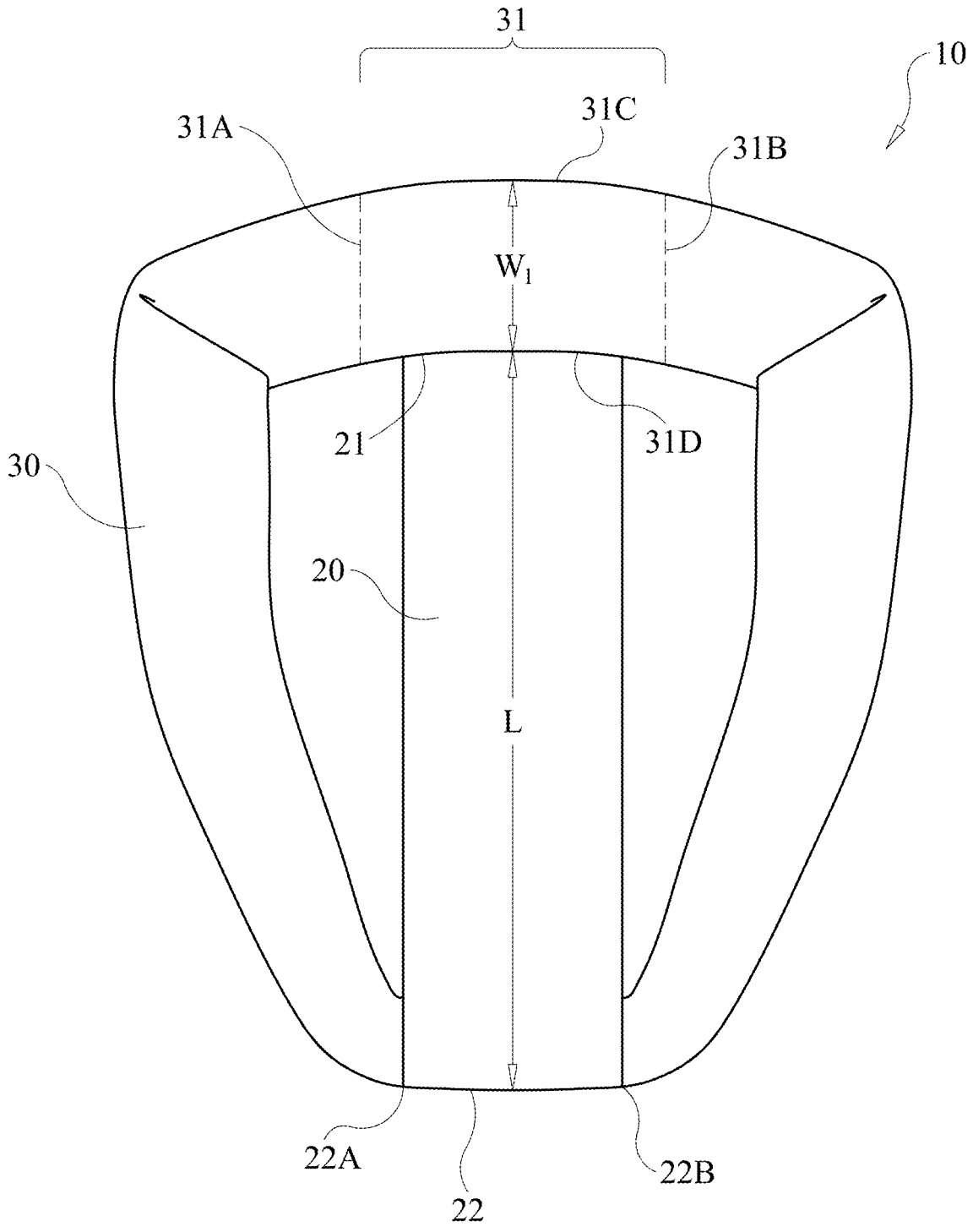
FIG. 1 illustrates a schematic plan view of an embodiment of a leg loop undergarment in a fully assembled state in accordance with various aspects as described herein.

Referring now to the drawings and more particularly to FIG. 1, a schematic plan view of an embodiment of a fully-assembled leg loop undergarment in accordance with the present disclosure is shown and is referenced generally by numeral 10. As will be described further below, undergarment 10 is a waistband-free undergarment that may be worn under a lower-body outer garment (e.g., tights, yoga pants, dress pants, shorts, skirts, dresses, etc.). Undergarment 10 is comfortable, is minimally visible when worn under an outer garment, and will not bunch up at the waist, crotch or buttocks regions of the person wearing the undergarment. By way of example, the undergarment will be described and shown as being worn by a woman. However, it is to be understood that the undergarment is not limited to being worn by women.

Undergarment 10 includes a fabric panel 20 and a strip 30 of elastic material(s) that is coupled to fabric panel 20 via stitching, fusing, gluing, etc. However, it is to be understood that fabric panel 20 and strip 30 may be constructed from a single piece of fabric or otherwise integrated with one another without departing from the scope of the present disclosure. Briefly, when worn by a woman, fabric panel 20 rests against the wearer's genitalia, while strip 30 wraps around the outside of the wearer's thighs and under the wearer's lower buttocks regions (i.e., under the cheeks). Each of panel 20 and strip 30 may be made from a single piece of material or multiple pieces of material without departing from the scope of the present disclosure.

Fabric panel 20 may be made from one or more layers of soft fabric suitable for coming into contact with a wearer's genitalia and surrounding skin regions. Fabric panel 20 may include moisture-absorbing, moisture-wicking, and/or deodorizing layer(s). Fabric panel 20 may be a simple rectangular panel (as shown in FIG. 1) or may be anatomically shaped for fit, comfort, etc. (as will be described further below), without departing from the scope of the present disclosure. In general, fabric panel 20 has a first end 21 and a second end 22. A length "L" of fabric panel 20 extends from its first end 21 to its second end 22.

Strip 30 is an elongate piece of elastic material that is coupled to first end 21 and second end 22 of fabric panel 20. In some embodiments, a suitable elastic material for strip 30 is an interlock or double-knit fabric as such fabrics are soft and resist curling when stretched. Materials typically used for interlock fabrics include, but are not limited to, cotton, wool, spandex, polyester, and combinations thereof.

Figure 2:
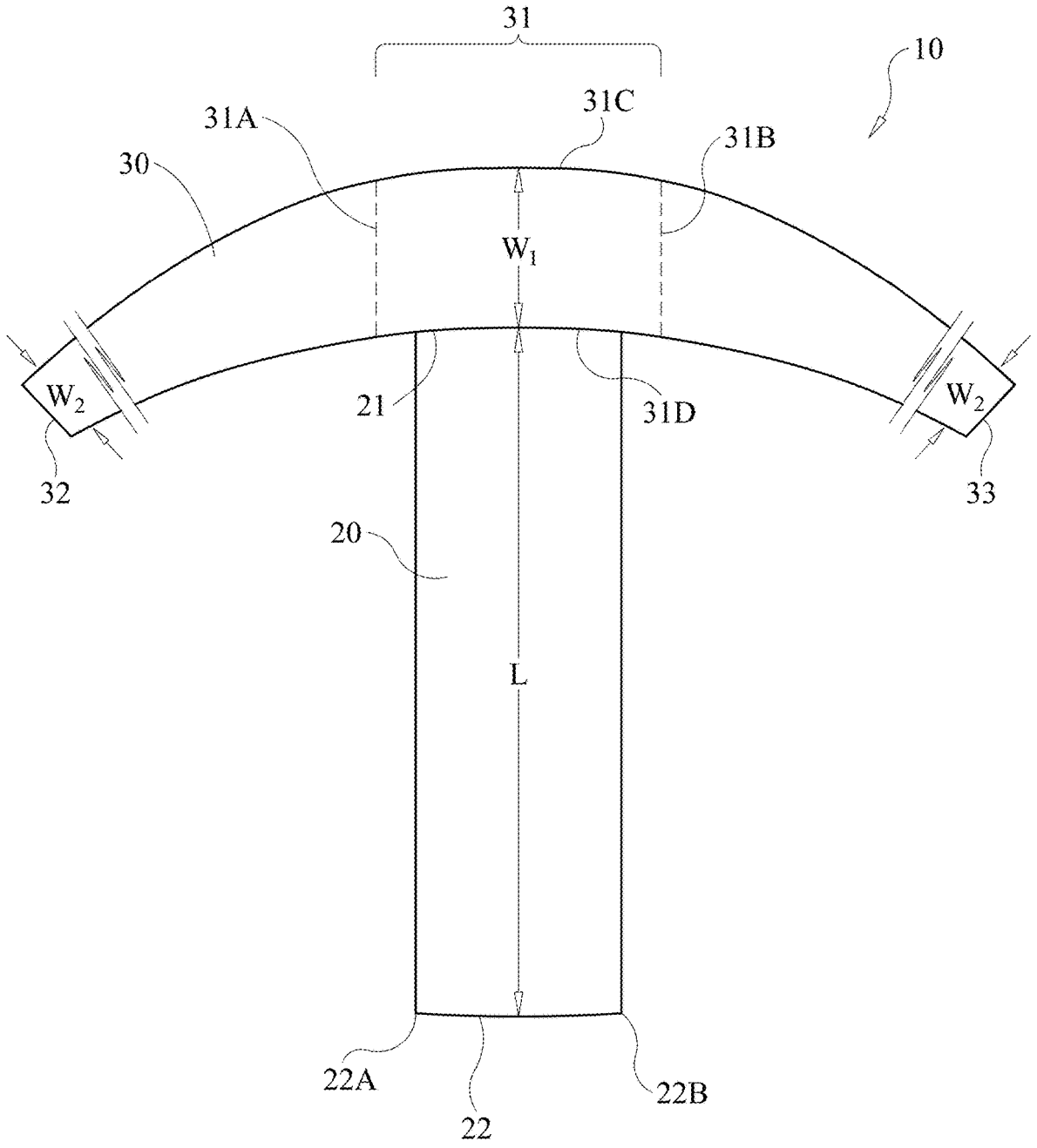
FIG. 2 illustrates a plan view of an embodiment of the leg loop undergarment in a partially assembled state in accordance with various aspects as described herein.

Referring additionally now to FIG. 2, leg loop undergarment 10 (shown in FIG. 1) is illustrated with undergarment 10 in a partially assembled state. Strip 30 has a central region 31 (i.e., the region between dashed lines 31A and 31B) and outboard ends 32 and 33. Central region 31 has an edge 31C that remains free after strip 30 is joined to fabric panel 20 at an interface edge or region 31D. Free edge 31C may be curved (as shown) or shaped in other ways without departing from the scope of the present disclosure. Each of the strip's outboard ends 32 and 33 are coupled to the second end 22 of fabric panel 20. More specifically, outboard end 32 is coupled to one side 22A of second end 22, while outboard end 33 is coupled to the other/opposing side 22B of second end 22. In general, strip 30 is widest at its central region 31. Further, strip 30 tapers in width from its central region 31 to each of its outboard ends 32 and 33. The width "$W_1$" of some or all of central region 31 is greater than the width "$W_2$" of outboard ends 32 and 33. In some embodiments, width $W_2$ is the same at each of outboard ends 32 and 33. The tapering between central region 31 and outboard ends 32/33 may occur in a continuous fashion or in discrete steps without departing from the scope of the present disclosure.

The above-referenced dimensions of L for fabric panel 20 and $W_1$ and $W_2$ for strip 30 are varied for different sizes of undergarment 10. In some embodiments, a good fit and function may be achieved when one or both of the following ratios satisfy the disclosed numeric range. The first of the ratios relates the width $W_1$ of central region 31 to the width $W_2$ of outboard ends 32 and 33. For a broad size range of extra-small to a plus size, the ratio ($W_1/W_2$) may be in the range of 1.5 to 14.3. The second of the ratios includes the length L of fabric panel 20 and the width $W_1$ of central region 31 of strip 30. For a broad size range of extra-small to a plus size, the ratio $L/(L+W_1)$ may be in the range of 0.62 to 0.91. The minimum-to-maximum ranges for the above-described ratios on a size basis are as follows:

| Size | $(W_1/W_2)_{MIN}$ | $(W_1/W_2)_{MAX}$ | $(L_1/(L + W_1)_{MIN}$ | $(L_1/(L + W_1)_{MAX}$ |
|---|---|---|---|---|
| X-small | 1.9 | 14.3 | 0.62 | 0.84 |
| Small | 1.9 | 11.8 | 0.62 | 0.84 |
| Medium | 1.7 | 9.5 | 0.62 | 0.85 |
| Large | 1.7 | 8.1 | 0.62 | 0.86 |
| Plus | 1.5 | 7.6 | 0.65 | 0.91 |

Figure 3A:
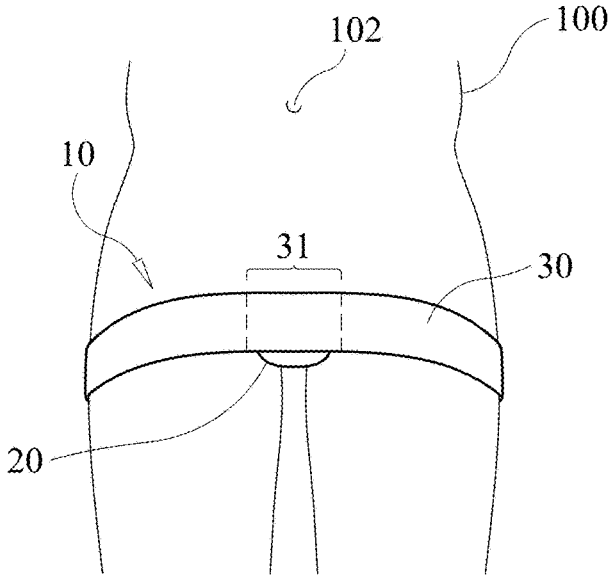
FIG. 3A illustrates a front view of the leg loop undergarment when worn by a user in accordance with various aspects as described herein.
Figure 3B:
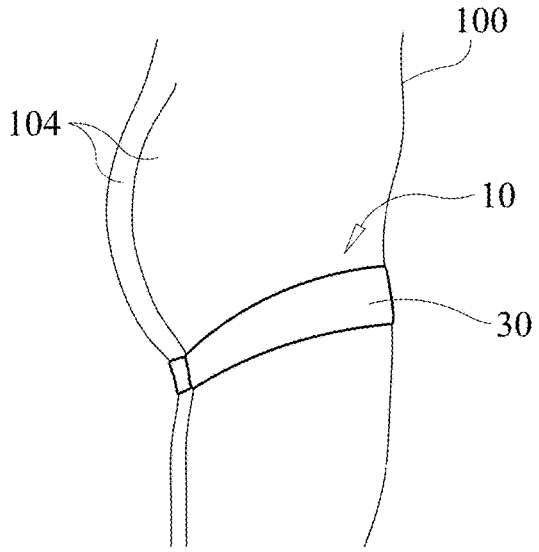
FIG. 3B illustrates a side view of the leg loop undergarment when worn by a user in accordance with various aspects as described herein.
Figure 3C:
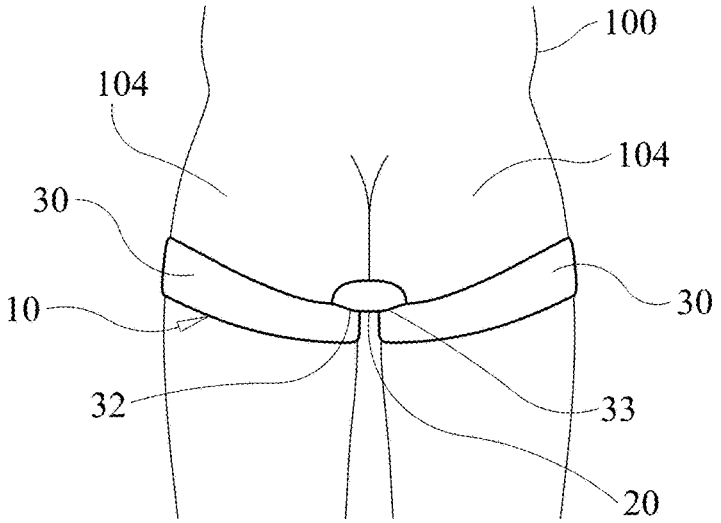
FIG. 3C illustrates a back view of the leg loop undergarment when worn by a user in accordance with various aspects as described herein.

Referring now additionally and simultaneously to FIGS. 3A to 3C, the above-described leg loop undergarment is illustrated as it would appear when being worn by a person (e.g., a woman) 100 where FIG. 3A is a front view, FIG. 3B is a side view, and FIG. 3C is a back view. Central region 31 of strip 30 resides against the lower abdomen region below the belly button 102 of the person 100. The width $W_1$ of central region 31 may be in the range of 3.5 to 16 centimeters with smaller values being used for smaller sizes and larger values being used for larger sizes. As mentioned above, strip 30 tapers in width to the smaller width $W_2$ at its outboard ends 32 and 33 where width $W_2$ may be in the range of 0.7 to 7 centimeters with smaller values being used for smaller sizes and larger values being used for larger sizes. The combination of width $W_1$/length L with the attachment of strip 30 at second end 22 of fabric panel 20 assures the following:

- that fabric panel 20 remains securely positioned over and against the wearer's genitalia, and
- that strip 30 is securely retained against the wearer's lower abdomen region so that fabric panel 20 does not move forward or backward on the wearer thereby keeping it minimally visible.

In addition, since strip 30 is tapered from its central region 31 and extends under the lower portion of the buttocks 104 and since undergarment 10 is a waistband-free undergarment, strip 30 is virtually invisible under one's outer garment (not shown).

Figure 4A:
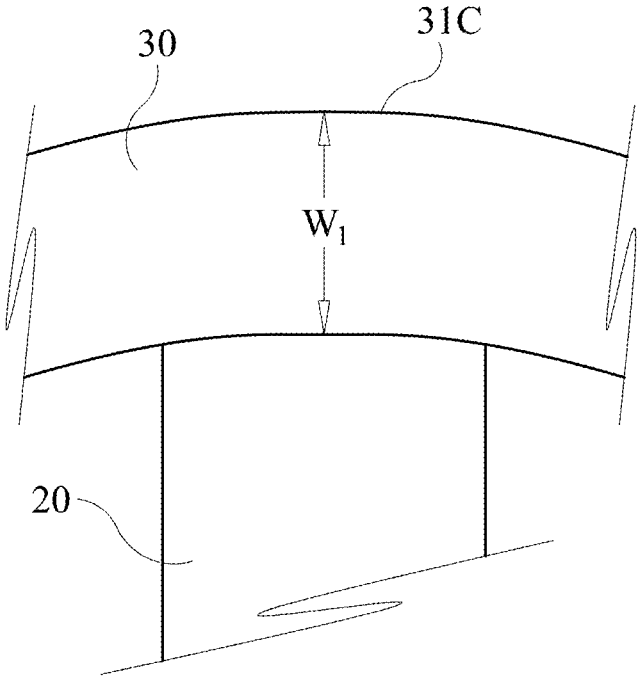
FIG. 4A illustrates a partial plan view of another embodiment of a leg loop undergarment in accordance with various aspects as described herein.
Figure 4B:
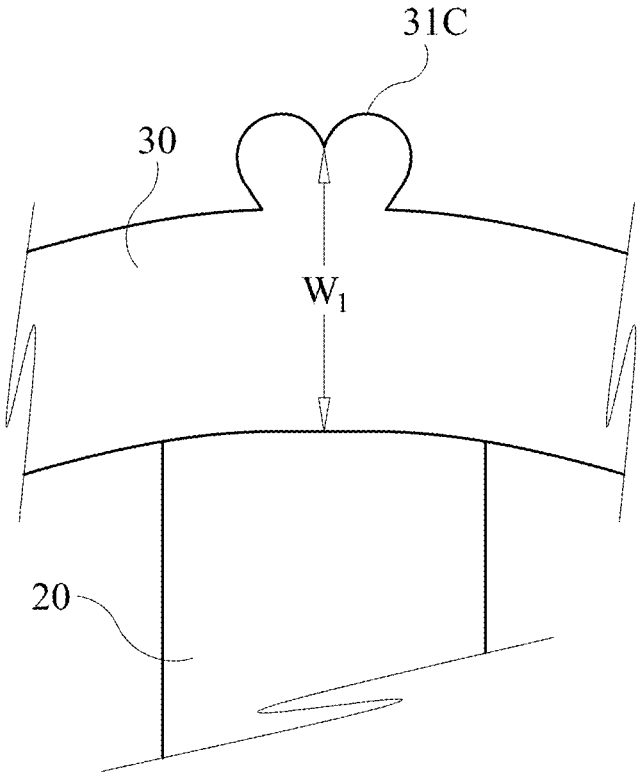
FIG. 4B illustrates a partial plan view of another embodiment of a leg loop undergarment in which the elastic strip's central region includes a heart-like design shape in accordance with various aspects as described herein.
Figure 4C:
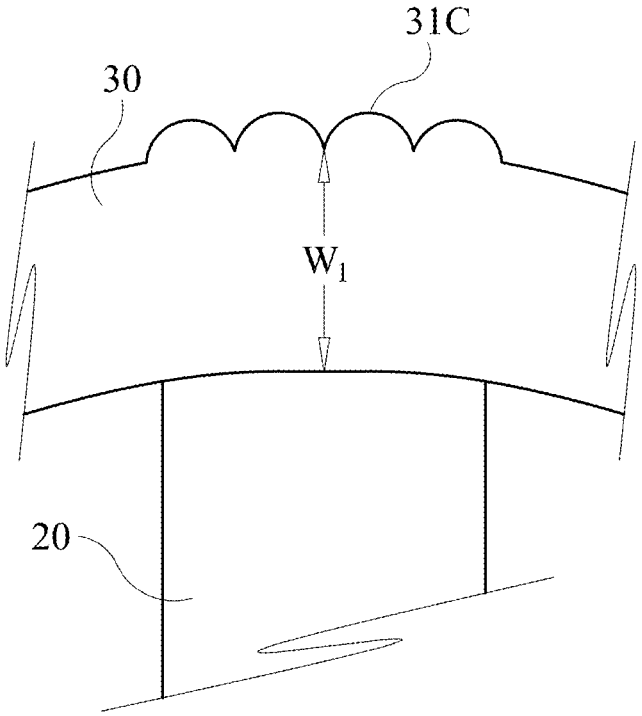
FIG. 4C illustrates a partial plan view of another embodiment of a leg loop undergarment in which the elastic strip's central region includes a scallop design shape in accordance with various aspects as described herein.
Figure 4D:
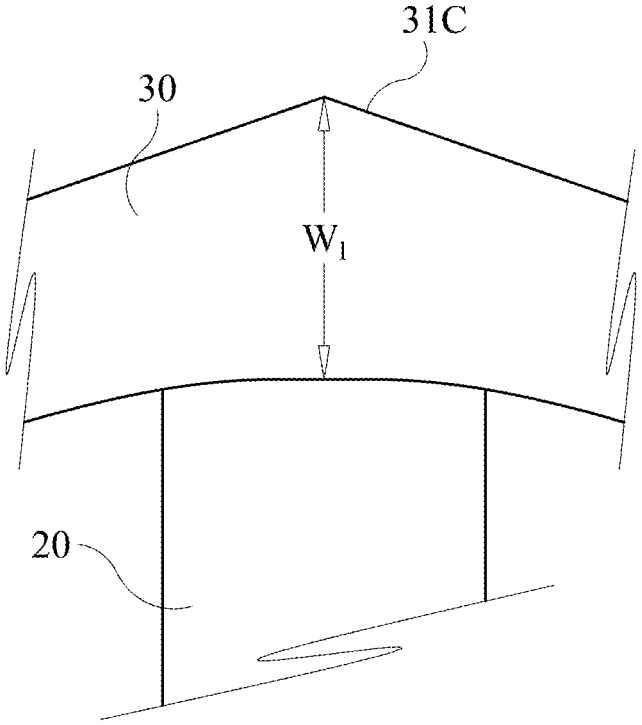
FIG. 4D illustrates a partial plan view of another embodiment of a leg loop undergarment in which the elastic strip's central region includes a triangular design shape in accordance with various aspects as described herein.

The strip of elastic material described above may be configured in a variety of ways for design or aesthetic purposes (e.g., curved as shown in FIG. 2) without departing from the scope of the present disclosure. For example, the free edge of the strip's central region may serve as a location on the undergarment to implement design features. Several non-limiting examples of the strip's free edge at its central region are illustrated in FIGS. 4A to 4D. FIG. 4A illustrates a strip 30 with a free edge 31C configured with a straight-line edge. FIG. 4B illustrates a strip 30 with a free edge 31C configured as the upper portion of a heart shape. FIG. 4C illustrates a strip 30 with a free edge 31C configured as a scallop design. FIG. 4D illustrates a strip 30 with a free edge 31C configured as the upper portion of a triangle. In each embodiment, the width $W_1$ is indicated.

Figure 5:
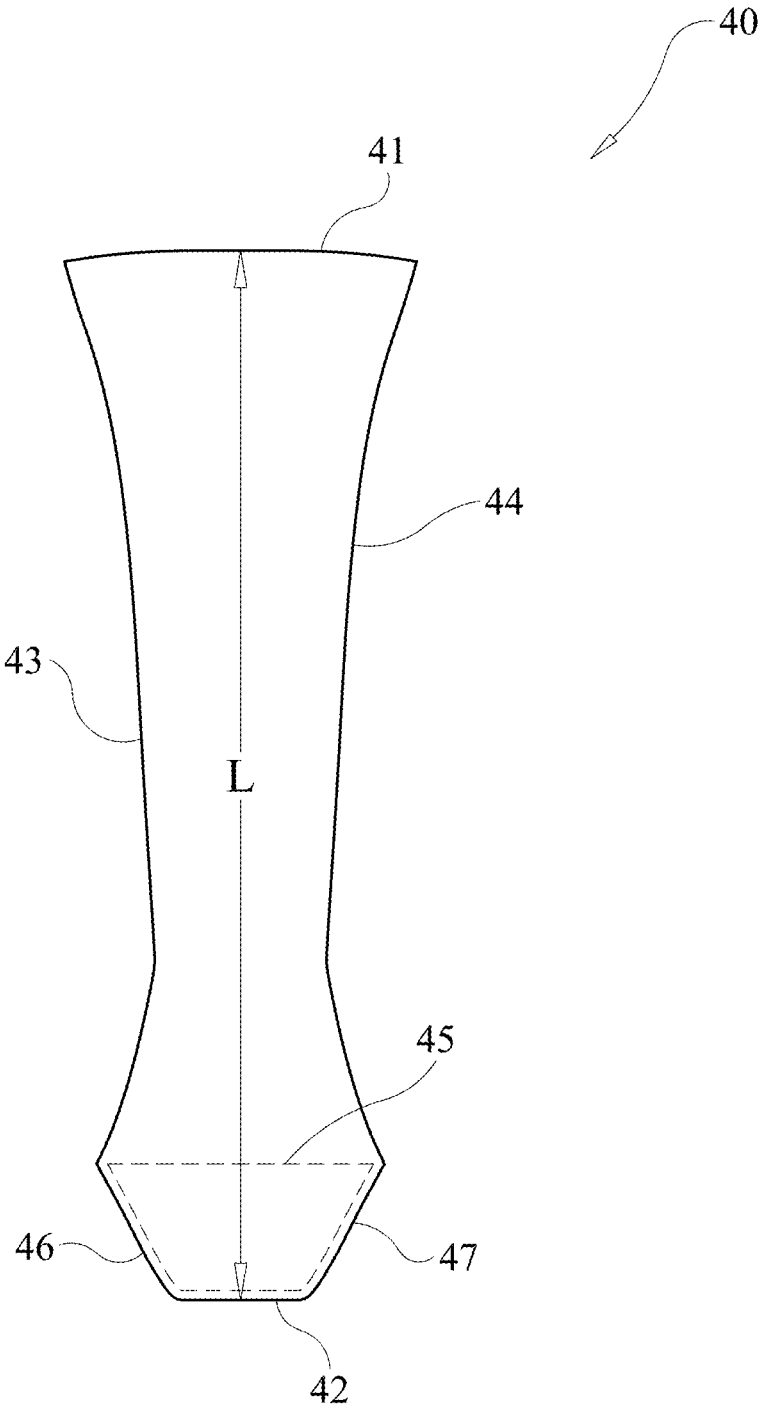
FIG. 5 illustrates an isolated plan view of an embodiment of an anatomically-shaped fabric panel for a leg loop undergarment in accordance with various aspects as described herein.
Figure 6:
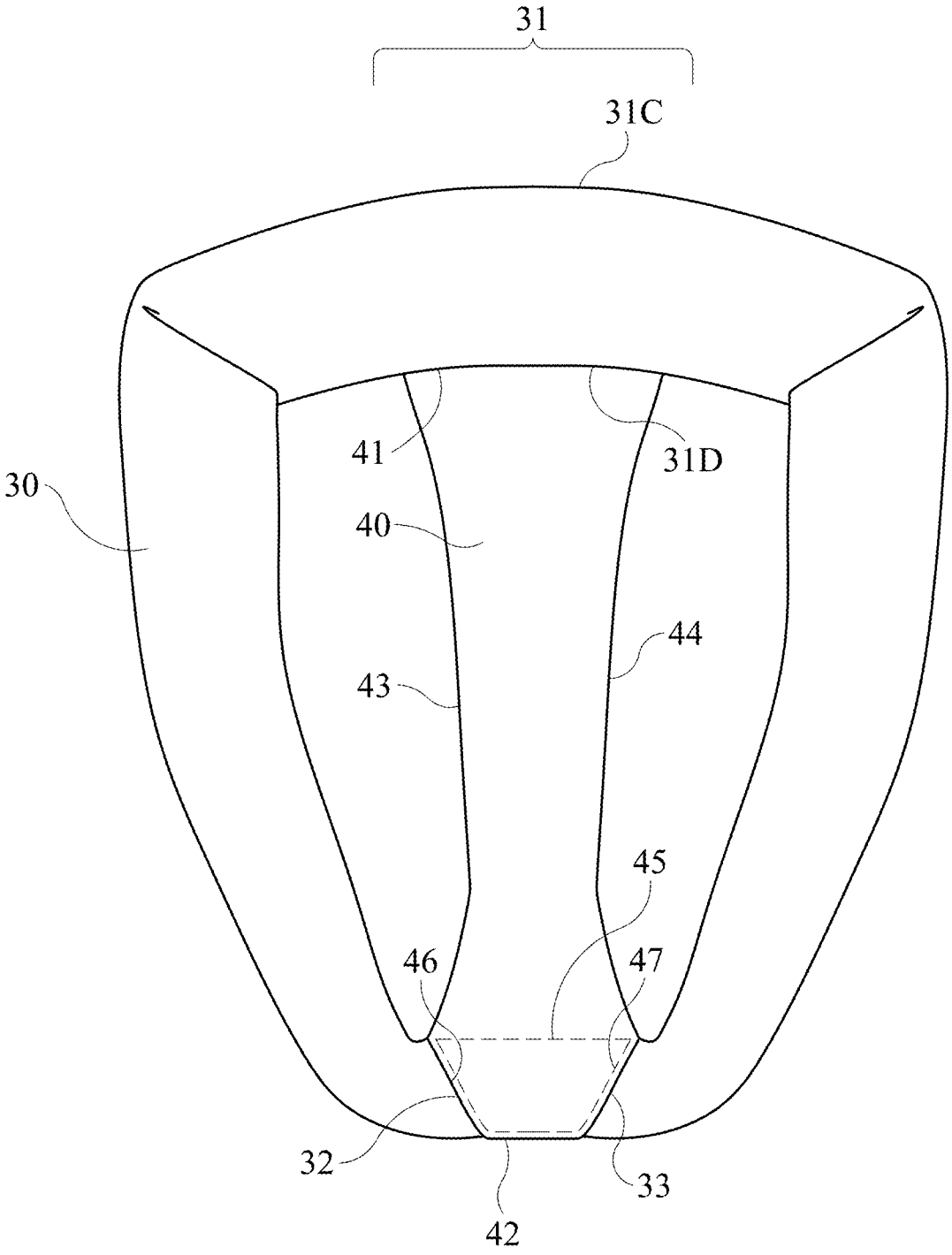
FIG. 6 illustrates a schematic plan view of another embodiment of a leg loop undergarment constructed using the fabric panel illustrated in FIG. 5 in accordance with various aspects as described herein.

As mentioned above, the fabric panel in the described leg loop undergarment may be anatomically shaped. For example and with simultaneous reference to FIGS. 5 and 6, a fabric panel 40 is anatomically shaped to facilitate comfort when it interfaces with a wearer's inner thighs. In addition, fabric panel 40 is configured to cause strip 30 to lie flat against the wearer's skin when the strip's outboard ends are joined to the fabric panel. More specifically, fabric panel 40 has a first end 41, a second end 42, and a measured length L measured from first end 41 to second end 42. In addition, the opposing side edges 43 and 44 of fabric panel 40 are concave to follow the curves of a wearer's inner thighs. The second end 42 of fabric panel 40 is the shortest base of a trapezoid-shaped region of fabric panel 40 as indicated by dashed-lines 45. The two legs 46 and 47 of trapezoid-shaped region 45 serve as the interfaces or join regions for the attachment of outboard ends 32 and 33, respectively.

The advantages of the leg loop undergarment described herein are numerous. The undergarment's minimalist coverage of the wearer's buttocks and waistband-free design present the desired appearance of wearing "nothing at all" under a lower-body outer garment. At the same time, the undergarment's unique strip with its wider central region provides the comfort and feel of traditional panties at the wearer's lower abdomen region. Further, the undergarment's unique dimensioning of the strip's central region and length of its fabric panel, as well as the coupling of the strip to opposing sides of the second end of the fabric panel, assure the retention of the fabric panel in its proper position for coverage of the wearer's genitalia. As a result, the leg loop undergarment provides a new minimalist panty that is visually appealing, protects sensitive body regions, is hygienic, and protects outer garments.

Figure 7:
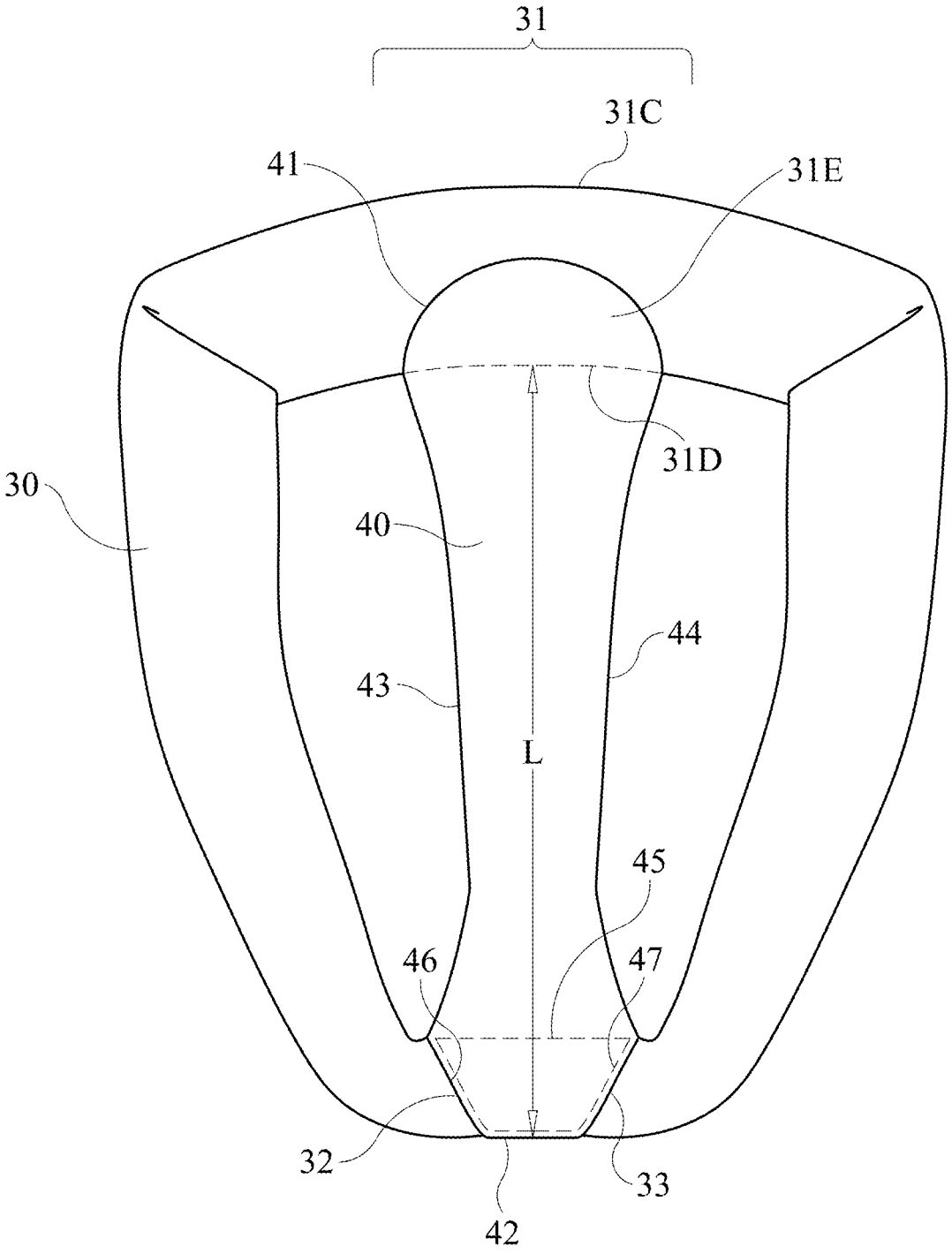
FIG. 7 illustrates a schematic plan view of another embodiment of a leg loop undergarment in accordance with various aspects as described herein.

Although the methods and systems presented herein have been described for specific embodiments thereof, there are numerous variations and modifications that will be readily apparent to those skilled in the art in light of the above teachings. For example, the leg loop undergarment may include a variety of technical and/or aesthetic fabrics without departing form the scope of the present disclosure. The strip and fabric panel may be joined at their edges or may partially overlap one another without departing form the scope of the present disclosure. This is illustrated in FIG. 7 where the first end 41 of fabric panel 40 overlaps a portion 31E of strip 30 in its central region 31 and where the effective length L of fabric panel 40 extends from edge region 31D to second end 42. Region 31E may contain overlapping fabric, continuous layer(s), or fabric from only the panel or the strip without departing from the scope of the present invention. It is therefore to be understood that, within the scope of the appended claims, the methods and systems presented herein may be practiced other than as specifically described.

What is claimed as new and desired to be secured by Letters Patent of the United States is:

1. An undergarment, comprising:

a fabric panel having a first end and a second end;

a strip of elastic material having a central region, a first outboard end, and a second outboard end, said strip having a width that tapers from said central region to each of said first outboard end and said second outboard end, wherein said fabric panel has a length L measured from said first end to said second end, wherein said width of said strip at said central region is $W_1$, and wherein a ratio $L/(L+W_1)$ is in a range of 0.62 to 0.91;

said central region being coupled to said first end of said fabric panel; and said first outboard end and said second outboard end being coupled to opposing sides of said second end of said fabric panel.

2. The undergarment of claim 1, wherein said strip of elastic material comprises an interlock fabric.

3. The undergarment of claim 1, wherein said width of said strip is the same at said first outboard end and said second outboard end.

4. The undergarment of claim 1, wherein said width of said strip at each of said first outboard end and said second outboard end is $W_2$, and wherein a ratio $W_1/W_2$ is in a range of 1.5 to 14.3.

5. An undergarment, comprising:

a fabric panel having a first end and a second end, said fabric panel having a length L measured from said first end to said second end;

a strip of elastic material having a central region, a first outboard end, and a second outboard end, said strip having a first width $W_1$ at said central region, said strip having a second width $W_2$ at each of said first outboard end and said second outboard end, wherein a ratio $W_1/W_2$ is in a range of 1.5 to 14.3, and wherein a ratio $L/(L+W_1)$ is in a range of 0.62 to 0.91;

said central region being coupled to said first end of said fabric panel; and said first outboard end and said second outboard end being coupled to opposing sides of said second end of said fabric panel.

6. The undergarment of claim 5, wherein said strip of elastic material comprises an interlock fabric.

7. An undergarment, comprising:

a fabric panel having a first end and a second end, wherein said second end is a shortest base of a trapezoid-shaped region of said fabric panel, and wherein said trapezoid-shaped region has a first leg and a second leg;

a strip of elastic material having a central region, a first outboard end, and a second outboard end, said strip having a width that is greatest at said central region, said width of said strip tapering from said central region to each of said first outboard end and said second outboard end, wherein said fabric panel has a length L measured from said first end to said second end, wherein said width of said strip at said central region is $W_1$, and wherein a ratio $L/(L+W_1)$ is in a range of 0.62 to 0.91;

said central region being coupled to said first end of said fabric panel;

said first outboard end being coupled to said first leg of said trapezoid-shaped region; and said second outboard end being coupled to said second leg of said trapezoid-shaped region.

8. The undergarment of claim 7, wherein said strip of elastic material comprises an interlock fabric.

9. The undergarment of claim 7, wherein said width of said strip is the same at said first outboard end and said second outboard end.

10. The undergarment of claim 7, wherein said width of said strip at each of said first outboard end and said second outboard end is $W_2$, and wherein a ratio $W_1/W_2$ is in a range of 1.5 to 14.3.

* * * * *